United States Patent [19]

Maruszak

[11] 4,114,876

[45] Sep. 19, 1978

[54] POOL TABLE GOLF GAME

[76] Inventor: John E. Maruszak, 1247 Home Ave., Berwyn, Ill. 60402

[21] Appl. No.: 819,673

[22] Filed: Jul. 28, 1977

[51] Int. Cl.[2] ..... A63F 7/06

[52] U.S. Cl. ..... 273/87 B; 273/4 A; 273/14; 273/123 R

[58] Field of Search ..... 273/87 B, 87 R, 14, 273/12, 4 A, 4 R, 5 R, 123 R

[56] References Cited

U.S. PATENT DOCUMENTS

| | | | |
|---|---|---|---|
| 235,861 | 12/1880 | Estephe | 273/4 A |
| 736,938 | 8/1903 | Clark | 273/123 R |
| 1,221,181 | 4/1917 | Hooper | 273/87 B |
| 1,813,116 | 7/1931 | Clausen | 273/14 |
| 3,138,387 | 6/1964 | Michel et al. | 273/123 R |
| 3,534,961 | 10/1970 | Tiley | 273/87 C |
| 3,858,877 | 1/1975 | Lundstrom | 273/12 |
| 3,871,650 | 3/1975 | Casey | 273/123 R |
| 4,004,804 | 1/1977 | Gholson | 273/123 R |
| 4,010,949 | 3/1977 | Lee | 273/4 A |

*Primary Examiner*—Richard C. Pinkham
*Assistant Examiner*—Harry G. Strappello
*Attorney, Agent, or Firm*—Robert E. Wagner; Thomas L. Kautz

[57] ABSTRACT

A golf game apparatus in combination with a conventional pool table is provided by the present invention in which the skills developed in playing the game of pool are utilized in a simulated golf course environment including contoured golf greens, sand and water hazards, tees and flags, the object being to direct an object ball using a cue ball and cue stick as in the play of pool, from a designated tee area around the playing surface to a correspondingly designated golf cup or pocket, while avoiding the hazards randomly disposed on the playing surface as in the play of natural golf.

5 Claims, 7 Drawing Figures

FIG. 1
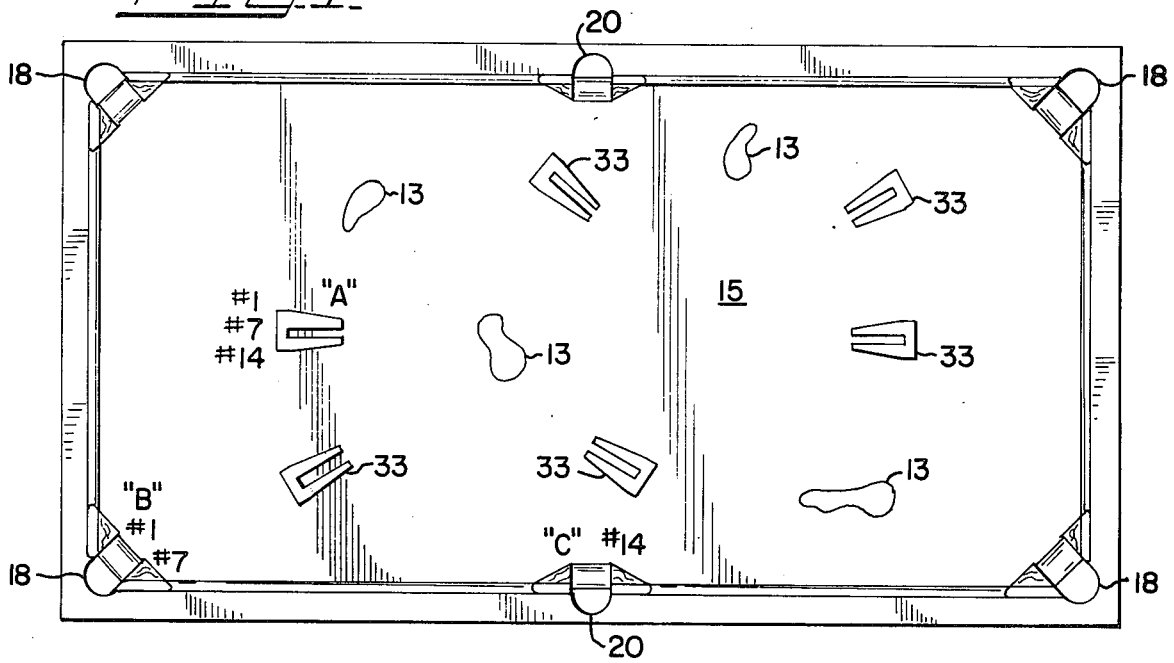
FIG. 2
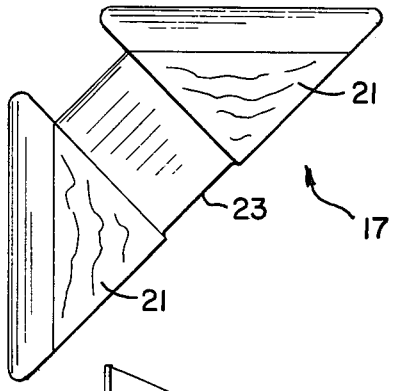
FIG. 3
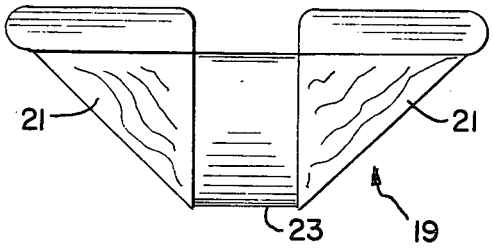
FIG. 4
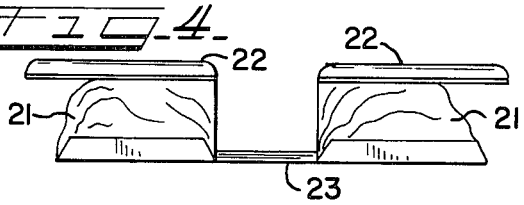
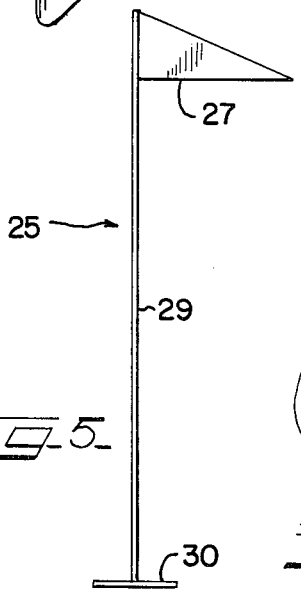
FIG. 5
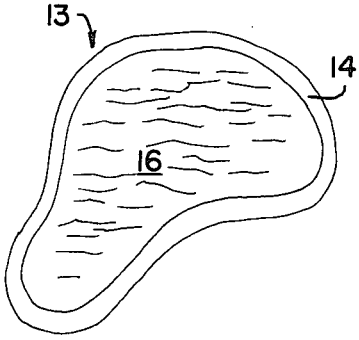
FIG. 6
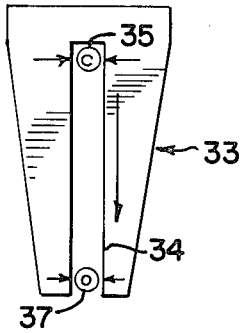
FIG. 7

POOL TABLE GOLF GAME

BACKGROUND OF THE INVENTION

This invention relates to a game apparatus and, more particularly, to a golf game apparatus adapted for use with pool tables of all sizes for simulated play of golf on the surface of a pool table.

Various games have been developed which simulate the play of golf on a miniature scale. Generally, these games involve the use of rigid playing boards or tables, sometimes flat or alternatively contoured to simulate grades, slopes, valleys, bunkers and water hazards found on natural golf courses. Other related game tables are constructed with a plurality of rails or projections arranged on the surface of the playing table to define a tortuous course between a starting point and a cup or hole. The object of these prior art games is to propel a miniature ball around the assorted protrusions and contours on the game table with hand manipulated clubs or sticks, to a ball receiving opening or cup.

Many of these prior art games employ protrusions which are permanently fixed or painted on the surface of the game table, which severely limits these games in variety and in any possibility of posing new problems of play. Additionally, most prior art games of this type are designed primarily to simulate the manner in which golf is normally played, by using a club or stick to propel a single ball on the game table to a cup or hole.

SUMMARY OF THE INVENTION

In contrast to the above-described inventions, the present invention requires the players to combine the skills and techniques used in the play of billiards or pool, within a simulated golf course setting which includes sand traps or bunkers, water hazards, tees and greens. Unlike existing types of miniature golf games adapted for use with pool tables or other kinds of game tables, the present invention uses both a cue ball and an object ball, as in normal pool or billiards. This provides a challenging and interesting added dimension to the present game not found in existing games.

As discussed in detail below, in the present game a plurality of sand and water hazards are randomly disposed on the surface of a pool table. Sections formed of structural foam or an equivalent are also provided, which are adapted with the pockets of the pool table to form the golf greens of the present game, with the pockets simulating golf cups. The players must propel a cue ball from a tee area, using a standard cue, to strike an object ball, and direct it to the designated pocket or cup in the manner of playing normal pool. The table cushions are an integral part of this game, as in regular pool, and the same English or spins sometimes used in pool may be useful in the play of this game. However, the placement of the sand and water hazards on the table top, and the designation of a particular pocket as the target cup, present an interesting challenge even for those already skilled in the play of pool.

In playing the game of the present invention, one must direct the object ball around a variety of hazards before a clear shot at the green, which extends outwardly from the cup or pocket, is possible. The hazards and tees herein are removable independent elements which may be placed at random positions on the pool table as desired to increase the difficulty of the game and pose new problems of play. As will become apparent, players must control the position of both the cue and object balls, unlike prior art games in which only one ball was used, to avoid having a shot blocked by a hazard or tee which may be positioned therebetween.

As discussed in more detail below, the game of the present invention may be played simultaneously with several players, which further adds to the challenge and expertise required for play. One must not only cope with the problems presented by the various hazards when several players are involved, but strategy becomes an important element of the game. Each players must play around the others' balls, and position himself to avoid being diverted from a shot by another player.

Accordingly, it is an object of the present invention to provide a golf game apparatus adapted for use with pool tables of all sizes.

It is a further object of this invention to provide a golf game apparatus in which both a cue and object ball are used, providing an interesting and challenging adaptation of the skills involved in the play of pool to a simulated golf course environment.

It is another object of the present invention to provide a golf game apparatus consisting of independent removable elements including tees and hazards which may be placed at random positions along the surface area of the pool table, which are easily removed for play of normal pool.

It is still another object of this invention to provide a game apparatus having sections formed of such as structural foam or polyurethane adapted with the pockets of the pool table to form the golf greens of the present game with the pockets simulating the golf cups.

Objects in addition to the foregoing will become apparent upon examination of the following description taken in conjunction with the drawings wherein:

DESCRIPTION OF THE DRAWINGS

FIG. 1 is a top perspective view of one embodiment of the present invention showing a particular orientation of the tees and hazards on the pool table playing surface;

FIG. 2 is a top perspective view of a golf green of the present invention which is adapted for positioning adjacent the corner pockets of the pool table;

FIG. 3 is a top perspective view of a golf green of the present invention which is adapted for positioning adjacent the side pockets of the pool table;

FIG. 4 is a front view in full elevation of the greens of FIGS. 1 and 2 showing the contoured portions of the sides of the green and the slight elevation of the central portion of the green from front to back toward the pocket or golf cup of the game;

FIG. 5 is one embodiment of a flag which is inserted into the pockets of the table to identify the pockets as respective holes of the present game;

FIG. 6 is a top perspective view of a hazard, which may represent either sand or water, and which is disposed at random positions around the playing surface as in FIG. 1; and, FIG. 7 is a tee of the present invention showing the cue and object balls in a position to begin play.

DESCRIPTION OF THE INVENTION

Referring now to FIG. 1, one embodiment of the present invention is shown having a particular arrangement of tees 33 and hazards 13 on the playing surface or bed 15 of a standard size pool table. The present game will be described in terms of the orientation of tees 33 and hazards 13 as in FIG. 1, but it should be understood that other arrangements are readily adapted for the play of this game to pose new problems of play as desired. In addition, the embodiment of FIG. 1 shows the present game adapted for play on a pool table eight feet in length, but tables of 6 or 7 feet in length may also be used, as well as snooker opening tables of various lengths.

Referring now to FIGS. 2, 3 and 4, sections formed of a durable material such as structural foam, polyurethane or an equivalent, are provided, which, in combination with the pockets of the pool table, form the golf greens of the present invention with the pockets simulating golf cups as discussed in detail below. The green 17, as shown in FIG. 2, is positionable adjacent the corner pockets 18 of the pool table, and the green 19 of FIG. 3 is placed adjacent the side pockets 20 of the pool table. Side portions 21 of greens 17 and 19 extend upwardly from the surface of the table, as shown in FIG. 4, and are contoured and textured to provide a pleasing mound-like effect as found in many greens on natural golf courses. The side portions 21 of greens 17 and 19 are connected by a center portion 23, which, in the embodiment of FIG. 1, is formed with a one-quarter inch rise from front to back relative to the playing surface 15. As discussed below, in playing the present game, a ball is directed over the center portions 23 of greens 17 and 19 into the pockets of the pool table to end each hole of play, and the slightly raised center portion 23 adds to the difficulty of propelling the ball into the pocket.

Greens 17 and 19 are formed to fit snugly to the cushions of the pool table adjacent the corner 18 and side 20 pockets, respectively. As shown in FIG. 4, the top section 22 of the side portions 21 of greens 17 and 19 extends over the rail of the table and into the pocket opening formed by the cushions to prevent the greens 17 and 19 from shifting during play. In addition, the perimeter of side portions 21, facing outwardly to the playing surface 15, is formed in a wedge shape to cause balls to roll off of greens 17 and 19 when propelled thereagainst to improve the position of the ball for a subsequent shot.

Referring now to FIG. 5, flags 25 consisting of a penant 27 attaching to a pole 29 formed with a base 30, are inserted into the pockets of the pool table to identify the pockets as respective cups for the successive golf holes of the present invention. In the embodiment of FIG. 5, the penants 27 of flags 25 are numbered to identify the gold cups for three separate holes of the present game, with each of the six pockets of the pool table receiving a flag 25 to designate a total of eighteen holes of the present game, as in a natural game of golf. Other types of penants 27 may be employed wherein each penant 27 has a single hole number, and eighteen separate poles 29 are used, with three poles 29 being inserted into each pocket.

FIG. 6 depicts a hazard 13, which is shaped as shown for purposes of illustration, but may be randomly shaped as in FIG. 1. Hazards 13 are formed in two layers, with the bottom layer contacting the playing surface 15 being made of a plastic film or a suitable equivalent having static adhesion properties for anchoring the hazard 13 to the playing surface 15. The upper surface of hazard 13 is formed with a slightly raised heat seal 14 around the edge for stopping or diverting balls propelled thereagainst. The heat seal 14 forms a basin or envelope 16 within hazard 13 in which a soft powder material is encased to further secure the hazard 13 to the playing surface 14 and also to give the hazard 13 a more appealing and realistic appearance. The hazards 13 may be designated as bunkers or water depending on the color of the powdered material in the basin or envelope 16. As mentioned above, placement of the hazards 13 may be varied as desired to present different problems of play, with the arrangement shown in FIG. 1 being illustrative of one embodiment which has been found to be interesting and challenging.

Flat tee areas 33 having a U-shaped cut out section 34 are provided to initiate play of the game as discussed in detail below. As shown in FIG. 7, a cue ball 35 is placed on the bight portion of cut out 34 opposite an object ball 37 which is placeable at the open end of cut out 34. The cut out 34 defines a distinct path along which the cue ball 35 is propelled in the direction indicated, to strike the object ball 37 to initiate play on any hole. The bottom surface of the tee 33, contacting the playing surface 15, is made of a plastic film or an equivalent having static adhesion properties to secure the tee 33 to the playing surface 15. As discussed below, each tee 33 is designated as the starting point for three separate holes of the game, there being a total of six tees 33 correspondingly numbered with the flags 25 to make the eighteen successive holes of the subject game.

The game of the present invention is played in the following manner. In the embodiment of FIG. 1, for purposes of illustration, the tee 33 labeled as A is the starting point for holes #1, #7 and #14. The corner green 17, labeled B, is the target green for holes #1 and #7, while side green 19, labeled C, is the target green for hole #14. In actual play, the target greens will be identified by flags 25 placed into the pockets of the pool table. In playing the game, a player will use the A tee 33 for holes #1, #7 and #14, and will try to direct an object ball 37 into the correspondingly numbered pocket or cup identified by flags 25. The other tees 33 will be identified as the starting points for the remaining fifteen holes, with flags 25 indicating the corresponding target greens. As shown in FIG. 1, the tee 33 labeled as A is oriented on playing surface 15 such that the cut out 34 defines a path for the cue ball 35 to strike the object ball 37 in a direction opposite to the location of the target green 17 labeled B. It should be understood herein that the orientation of tee areas 33 is expressly intended to require players to propel the object ball 37 in some direction other than directly at the designated target green, with the degree of difficulty of each golf hole of the present game depending to a large extent on what direction the object ball 37 must be propelled to start play on each respective hole. In addition, hazards 13 may be placed at strategic positions in alignment with the path defined by the cut outs 34, as in FIG. 1, to add further difficulty to the holes.

Play is started by placing a cue ball 35 and an object ball 37 on the tee 33, as shown in FIG. 7. Using a standard pool cue, a first player propels the cue ball 35 along the cut out section 34 of tee 33 to strike the object ball 37 in the direction indicated. The object of the game is to propel the object ball 35 around the playing surface 15, simulating a fairway on a natural golf course, and into the designated pocket or cup using the fewest number of shots as possible. Scoring of the subject game is similar to natural golf. Each time the cue ball 35 is struck, a stroke is counted whether or not contact is made with an object ball 37. If an object ball 37 comes to rest in a hazard 31, either designated as sand or water, a penalty of one stroke is assessed and the ball 37 is removed from the hazard 31 and placed on the playing surface 15 in a position no closer to the designated cup. As discussed below, striking another player's ball 37 with one's own object ball 37 or the cue ball 35 results in a penalty stroke. The player with the lower number of shots at the end of the eighteen holes, is the winner.

Once the first player has shot the object ball 37 from the tee 33, or teed off, the second player retrieves the cue ball 35, places a second object ball 37 on the tee 33 and then also tees off. Up to 15 players may play the game at one time, one for each of the pool balls, but it has been found that a group of four or five players is an optimum number to avoid undue waiting between shots and for other reasons to become apparent below. When the last player has teed off, the first player must take his second shot from the position in which the cue ball 35 came to rest after the last player's tee shot. The second player then takes his shot from the point where the cue ball 35 comes to rest, and so on until all players have put their respective object balls 37 into the designated pocket or cup. The rules of the present game as described above are flexible and may be altered as desired to present varying problems of play.

The subject game may be played in two ways, depending on the skill of the players. In one instance, players mark their object balls 37 after their shots by placing such as a small piece of paper or cardboard on the playing surface 15 where their ball 37 came to rest, and then removing their balls 37 from the playing surface 15. This enables the player who is shooting to have a clearer path to a green 17 or 19 and the respective cup or pocket, which is not obstructed by other player's balls. In another instance, players do not remove their balls 37 from the playing surface 15 and, thus, in addition to the hazards 13 and tees 33, one must avoid any contact with other players' balls 37 or be penalized one shot. Of course, spotting or marking the balls 37 provides an easier game than the other manner of play, and may be desirable for inexperienced players or when many people are playing the game at one time.

Each tee is marked to identify which holes are to begin from that point, and as mentioned above, the flags 25 indicate the corresponding target cups. Players simply continue to direct the object ball 37 toward the proper cup using the cue ball 35 as in the normal play of pool, until the object ball 37 is shot into the cup. Once all players have completed a hole, the cue ball 35 is retrieved and play begins from another tee 33 with each player teeing off in succession as described above.

It is readily apparent that a good deal of skill is required to play the subject game without building up a high score. Each player must direct his object ball 37 around the hazards 13 and tees 33 placed on the playing surface 15. In one manner of play, other players' balls may also lie on the playing surface 15, creating further difficulties and reducing the chances of a clear shot at the target cup. In either manner of play, after one's tee shot, the position of the cue ball 35 is solely dependent upon where it comes to rest after the preceding player's shot. Prior art games wherein each player uses a single ball do not present the positioning problems of the subject game, and do not create interaction of play and dependence of one player's shot on the result of another's shot.

The greens 17 and 19 herein provide an added dimension to the subject game. As shown in FIG. 1, the side portions 21 of the greens 17 and 19 extend outwardly from the table cushions such that an object ball 37 will be blocked from the pocket or cup if shot toward the greens 17 and 19 at too sharp of an angle. Thus, only relatively straight-in shots will successfully avoid the side portions 21. In addition, the slight rise of the center portion 23 of greens 17 and 19 prevents balls 37 hit too softly or slowly from reaching the cup, further adding to the challenge of the present game.

Existing games of this type simply cannot provide the excitement, challenge and varying problems of play found in the present game. The present game involves strategic placement of the cue ball 35 as well as the object ball 37 to prevent other players from getting an unobstructed shot at the designated target cup and also to assure one's self of a clear shot. The cushions of the table also come into play, as many times the hazards 13 and tees 33 will require one to play the cue ball 35 or object ball 37, or both, off of one or more cushions to complete a shot.

Accordingly, a challenging and interesting game is provided in which the skills used in the play of pool are tested in a golf environment including greens, hazards and tees. The difficulty and variety of problems posed by the subject game largely result from the use of both a cue ball and object ball in contrast to existing games in which a single ball is used. Players must direct their object balls, as in the play of normal pool, around a variety of obstructions placed randomly on the playing surface, to reach the designated target cup in the least number of shots possible.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A simulated golf game apparatus, in combination with a pool table having a playing surface, cushions and pockets, said apparatus comprising a plurality of material sections formed of polyurethane or structural foam, each being positionable adjacent a pocket of said table to form the golf greens of said game with the pockets simulating golf cups, penants attaching to poles formed with a base to simulate golf flags placeable within respective pockets for identifying the pockets as successive golf holes, a plurality of hazard areas randomly disposed on the playing surface simulating bunkers and traps as on the fairways of natural golf courses, a cue ball and object ball, a plurality of tee areas having a shaped cut out section along a portion of the length of said tee forming a bight end and an open end of said cut out, said cue ball placeable at said bight end and said object ball at said open end, said cut out section defining a particular path for travel of said cue ball to strike said object ball for initiating play of said game, whereby players utilizing a conventional pool cue stick propel said cue ball into contact with said object ball from a designated tee area along the path defined by said cut out section, said object ball being directed around said playing surface by said cue ball as in the game of pool for simulating play along the fairways of a natural golf course while avoiding said hazards as in the play of the game of golf, said object ball being moved from a tee area to a correspondingly designated pocket for propelling said object ball into said pocket in the fewest number of shots as possible.

2. The apparatus of claim 1 wherein said material sections forming the golf greens of said game comprise a pair of end sections extending upwardly from said playing surface, said end sections being connected by a central portion disposed at a slightly upward angle from front to back relative to said playing surface, said end sections having a wedge-shaped perimeter to cause said cue ball and said object ball to roll away when shot thereagainst, said end sections having an overhanging portion fitting along the rail of said table cushions and extending into said pockets for stability of said golf greens during play, whereby said golf greens are placeable adjacent said pockets to receive said object ball providing the end point of play for each of the holes of said game.

3. The apparatus of claim 1 wherein said hazard areas are randomly shaped substantially flat sections having a bottom and upper layer, said bottom layer contacting said pool table bed being formed of a material having static adhesion properties, for securing said hazard to said playing surface during play, said top layer being formed as an envelope with a slightly raised heat seal around the outer edge, said envelope being filled with fluent material to define bunkers and water hazards as occur on natural golf courses, said hazards being randomly placeable on said pool table bed for obstructing the path of said object ball during play of said game, thereby adding challenge and difficulty to said game.

4. The apparatus of claim 1 wherein said tee areas are oriented on said playing surface for defining a path for said cue ball to strike said object ball to propel said object ball in a direction away from the correspondingly designated pocket, thereby requiring players to move said object ball around said playing surface as in the play of the game of pool to direct said object ball to the designated pocket.

5. The apparatus of claim 1 wherein the bottom portion of said tee is formed with a material having static adhesion properties, to secure said tee to the playing surface during play of said game while permitting easy removal of said tee from said playing surface to ready said table for the play of the game of pool.

* * * * *